United States Patent [19]

Donkers et al.

[11] Patent Number: 4,961,753

[45] Date of Patent: Oct. 9, 1990

[54] COMPOSITIONS AND PROCESS FOR THE TREATMENT OF TEXTILES

[75] Inventors: Annemieke C. M. Donkers, Kessel-Lo; George C. Sawicki, Rixensart, both of Belgium

[73] Assignee: Dow Corning Limited, Barry, Wales

[21] Appl. No.: 383,692

[22] Filed: Jul. 24, 1989

[30] Foreign Application Priority Data

Jul. 28, 1988 [GB] United Kingdom ..... 8817961

[51] Int. Cl.[5] ..... D06M 15/00; D06M 15/66

[52] U.S. Cl. ..... 8/115.65; 8/115.54; 8/DIG. 1; 252/8.6; 252/8.8; 427/387; 428/447

[58] Field of Search ..... 8/115.54, 115.65; 252/8.6, 8.8; 106/287.11, 287.12; 424/70

[56] References Cited

U.S. PATENT DOCUMENTS 4,098,701 7/1978 Burrill et al. ..... 252/8.6

4,631,207 12/1986 Price ..... 106/287.11

*Primary Examiner*—Paul Lieberman

*Assistant Examiner*—John F. McNally

*Attorney, Agent, or Firm*—Jim L. DeCesare

[57] ABSTRACT

Aqueous compositions comprising water having dispersed therein (A) a cationic compound which is substantive to water rinse on textile fabrics and (B) a mixture of a high viscosity polydiorganosiloxane and one or more methylsiloxanes having from 2 to 8 silicon atoms in the molecule.

The compositions are useful as fabric conditioners in domestic and commercial laundry operations.

7 Claims, No Drawings

COMPOSITIONS AND PROCESS FOR THE TREATMENT OF TEXTILES

This invention relates to a composition for the treatment of textiles and is concerned in particular with compositions which impart softness to textile fabrics. It also relates to a process for treating textiles with said compositions and to the treated textiles obtained thereby.

Compositions for imparting softness to textile fabrics and which are intended for application during or following laundering have been known and widely used for many years. Such materials are known as, for example 'fabric softeners' or 'fabric conditioning agents' and are generally designed for application during the rinsing stage of the laundering operation. The primary active constituents of such compositions have been cationic surface active compounds, for example the di(hydrogenated-tallow) dimethyl ammonium chlorides, diamido alkoxylated quaternary ammonium compounds and quaternised amido imidazolines. Such compounds are generally poorly soluble in water and are often employed in conjunction with emulsifying aids to assist dispersion.

It has been disclosed in British Patent Specification No. 1 549 180 that additional benefits e.g. easier ironing and pleasant handle can accrue if the cationic compound is applied to the fabric in conjunction with certain silicones. The preferred slicones for use according to G.B. 1 549 180 are stated to be those having a cationic character and which show an enhanced tendency to deposit on the fabric. The silicone should also have a viscosity of at least 100 cS and less than 8000 cS at 25° C. Although said compositions have represented a significant advance in the art of fabric softeners there has been a continuing search for improvements in properties such as the feel or drape of the treated fabric and rewettability in the case where the fabric is towelling.

According to the present invention there is provided an aqueous composition for the treatment of textiles which comprises water having dispersed therein (A) a cationic compound which is substantive to water rinse on textile fabrics and (B) a mixture comprising (i) from 5 to 30% by weight of a polydiorganosiloxane having a viscosity of at least 300 Pa.s at 25° C. and wherein at least 80 percent of the total organic substituents are methyl groups, any remaining substituents being monovalent hydrocarbon groups having from 2 to 6 inclusive carbon atoms, and (ii) from 95 to 70 percent by weight of a liquid methyl siloxane having from 2 to 8 inclusive silicon atoms in the molecule.

As Component (A) of the compositions of this invention there may be employed any cationic substance which is substantive to water rinse on textile fabrics and which is capable of imparting softness and/or lubricity to textile fabrics. A large number of such substances is known and includes quaternary ammonium compounds such as:

(a) Alkylmethyl quaternary ammonium compounds having either one $C_{18}$–$C_{24}$ alkyl chain or two $C_{12}$–$C_{30}$ alkyl chains, the long chain alkyl groups being most commonly those derived from hydrogenated tallow. Examples of such compounds are ditallowdimethyl ammonium chloride, ditallowdimethyl ammonium methyl sulphate, tallowtrimethyl ammonium chloride, dieicosyldimethyl ammonium chloride, tallowdimethyl(3-tallowalkoxypropyl) ammonium chloride, ditetradecyldimethyl ammonium chloride, didodecyldiethyl ammonium acetate and tallowtrimethyl ammonium acetate. (b) Amido alkoxylated quaternary ammonium compounds. Quaternary compounds of this type can be prepared from fatty acids or triglycerides and an amine e.g. diethylene triamine. The product is then alkoxylated with ethylene oxide or propylene oxide and quaternised with dimethyl sulphate. Compounds of type (ii) can be represented by the formula

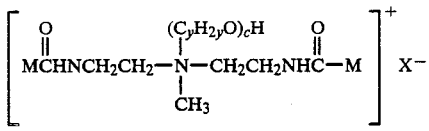

M represents a fatty alkyl group typically $C_{12}$ to $C_{20}$, X represents for example Cl, Br or the methyl sulphate group, y is 2 or 3 and c is an integer.

(c) Quaternised amido imidazolines. Compounds of this type can be obtained by heating the alkoxylated product of reacting an amine and a fatty acid or triglyceride as described for type (ii) to effect ring closure to the imidazoline. This is then quaternised by reaction with e.g. dimethyl sulphate. An example of a type (iii) compound is 2-heptadecyl-1-methyl-1-(2'-stearoyl amidoethyl)-imidazolinium methyl sulphate.

(d) Polyamine salts and polyalkylene imine salts e.g. $[C_{12}H_{25}NH(CH_3)-(CH_2)_3-NH_2C_{12}H_{25}]++\ Cl_2-$, $[C_{18}H_{37}NH(CH_3)-(CH_2)_2-NH(C_2H_5)_2++]CH_3SO_4)-_2$ and a polyethylene iminium chloride having about 10 ethylene imine units.

(e) Alkyl pyridinium salts e.g. cetyl pyridinium chloride.

The generally preferred cationic softening agents are those having long chain, fatty alkyl groups derived from tallow or hydrogenated tallow and the generally preferred class of softening agents are those of type (a), that is the alkylmethyl ammonium compounds.

Fabric conditioning agents which may be employed as component (A) of the compositions of this invention are well-known substances and have been widely described in the technical literature, see for example, J. Am. Oil Chemists Soc., January 1978 (Vol 55), pages 118–121 and Chemistry and Industry, 5th July 1969, pages 893–903.

Component (B) of the compositions of this invention is a mixture of a high viscosity polydiorganosiloxane (i) and a methylsiloxane (ii) having from 2 to 8 Si atoms in the molecule. The polydiorganosiloxane (i) should have a viscosity of at least 300 Pa.s at 25° C. and preferably has a viscosity of at least 1 Kilopascal second. Above such viscosities the polydiorganosiloxanes are gummy solids and viscosities the polydiorganosiloxanes are gummy solids and are usually more accurately characterised by their plasticity values. Most preferred are polydiorganosiloxanes having a plasticity in the range from about 120 mm/100 to about 200 mm/100 as measured according to ASTM Test D 926-67 (at 23° C.). At least 80 percent of the total silicon-bonded organic substituents in the polydiorganosiloxanes (i) are methyl groups. Any remaining groups are monovalent hydrocarbon groups having from 2 to 6 carbon atoms, for example ethyl, propyl, hexyl, vinyl, allyl and phenyl. Preferred on economic grounds are polydiorganosiloxanes wherein all or substantially all of the organic substituents are methyl. The polydiorganosiloxane may or may not be end-stopped. Thus, for example, the terminal positions may be occupied by —OH, $OCH_3$ or —ONa groups, or by triorganosiloxy groups e.g. trimethylsiloxy, dimethylvinylsiloxy, methylphenylvinylsiloxy or dimethylphenylsiloxy.

The proportion of (i) in Component (B) may vary from 5 to 30% by weight based on the total weight of (i) and (ii). Preferably the proportion of (i) falls within the range from about 10 to about 20% by weight.

The methylsiloxanes (ii) may be cyclic or linear in structure and may be characterised as having boiling points below about 250° C. at normal pressure. They include the cyclopolydimethylsiloxanes $(Me_2SiO)_x$ wherein Me represents methyl and x has a value of from 3 to 8, and siloxanes $Me(Me_2SiO)_ySiMe_3$ wherein y is an integer of from 1 to 7. Specific examples of methylsiloxanes (ii) are hexamethylcyclotetrasiloxane, octamethylcyclotetrasiloxane, decamethylcyclopentasiloxane, hexamethyldisiloxane and octamethyltrisiloxane. Generally preferred are the cyclic methylsiloxanes $(Me_2SiO)_x$ wherein x has a value of 4, 5 or 6. The methylsiloxanes (ii) may be employed as the pure compounds or as mixtures of two or more compounds of differing x and/or y values. Cyclic siloxanes wherein x=3 are preferably employed as mixtures with cyclic siloxanes having higher x values.

The compositions of this invention comprise water having (A) and (B) dispersed therein. The cationic compounds (A) are generally soluble in water to some extent and may thus exist in the compositions of this invention dissolved or dispersed in the aqueous phase. The organosiloxane mixture (B) is substantially insoluble in water. Thus, the term 'dispersion' as employed herein is intended to include solutions as well as emulsions or other forms of dispersion wherein the disperse phase is insoluble in the aqueous phase. The compositions may be prepared by mixing (A) with the mixture of siloxanes (B) and thereafter emulsifying the resulting mixture in water. More conveniently, however, (A) and (B) are separately dispersed in water and the resulting dispersions mixed together, or alternatively (A) may be added to and dispersed in an aqueous emulsion of (B). Depending on the solubility characteristics of (A) emulsifying agents may be employed to facilitate dispersion in the aqueous phase or to stabilise the dispersion. The organosiloxane mixture (B) may be emulsified in water employing any suitable emulsifying agent. Preferred for this purpose are the non-ionic emulsifying agents examples of which are the ethoxylated alcohols, ethoxylated alkyl phenols, ethoxylated fatty acids, ethoxylated fatty acid esters and esters of sorbitan and glycerol. However, the nature of the emulsifying agent is not critical provided it is capable of producing a substantially stable emulsion of the organosiloxane mixture (B).

The concentration of (A) and (B) present in the aqueous compositions of this invention is not critical and depends on individual practical and commercial considerations. For example, the compositions should be sufficiently fluid as to be readily dispersible during the laundering operation. Also, they should preferably not be so dilute as to involve the cost of storing or transporting large volumes of water. Having regard to such considerations the preferred aqueous compositions are those wherein (A) and (B) are present in a total amount of from about 5% to 35% by weight based on the total weight of the composition.

Depending on the effect desired the relative proportions of (A) and (B) may be varied within wide limits, for example from 1 to 50 parts by weight of the cationic compound (A) per part by weight of (B). for the optimum range from soft and fluffy to firm and bodied. They also exhibit improved rewettability when compared with fabrics treated with the cationic compounds (A) alone or in combination with low viscosity polydimethylsiloxanes.

The following examples, in which the parts and percentages are expressed by weight, illustrate the invention.

EXAMPLE 1

A polydimethylsiloxane gum (13 parts) having a plasticity of 165mm/100 was thoroughly mixed with a mixture of cyclic methylsiloxanes (87 parts) containing $[(CH_3)_2SiO]_4$ (36 parts) and $[(CH_3)_2SiO]_5$ (42 parts) the remainder (9 parts) comprising cyclic methylsiloxanes having 3, 6 and 7 silicon atoms in the molecule. The resulting mixture of gum and cyclic siloxanes (330 parts) was emulsified in 637 parts of water by passage through a colloid mill and employing 33 parts of polyoxyethylene trimethylnonyl ether (Tergitol TMN 6) as emulsifying agent. The resulting non-ionic emulsion was designated Emulsion NA. By means of a similar technique a cationic emulsion of the mixture of gum and cyclic siloxanes was prepared employing the following formulation:

| | |
|---|---|
| siloxane mixture | 350 parts |
| Arquad 2C-75 (a 75% w/w solution in water of dicocodimethylammonium chloride) | 10 parts |
| Tergitol TMN 6 (a polyoxyethylene trimethylnonyl ether) | 25 parts |
| Acetic Acid | 1 part |
| Water | 584 parts |

The resulting emulsion was designated Emulsion CA.

A series of fabric conditioning compositions was then prepared by adding 1%, 2% or 3% by weight of Emulsion NA or balance of properties and economy it is preferred to employ from about 2 to 20 parts by weight of (A) per part by weight of (B). The compositions of this invention have the advantage that they can be formulated to impart to the treated fabrics a handle (feel) which can range from soft to firm. For example, we have found that the use of the higher ratios of (B) to (A) in conjunction with the lower proportions of (i) in (B) can result in the treated fabric having a soft and fluffy handle. When higher proportions of (i) are employed with lower ratios of (B) to (A) the treated fabric has a firmer handle with more body.

The aqueous compositions may contain in addition to (A), (B) and water other, optional, ingredients for example perfumes, viscosity control agents, optical brighteners, colorants, opacifying agents, soil release agents, biocides and fabric treating agents such as the fatty acid esters of monohydric and polyhydric alcohols. Such additional ingredients may be added to the preformed aqueous composition comprising (A) and (B) or may be incorporated in admixture with (A) and (B).

The compositions of this invention can be employed to treat textile fabrics by any suitable technique, for example by immersion of the fabric in an aqueous liquor containing (A) and (B). They are particularly adapted for use as fabric conditioners in domestic and commercial laundry operations by addition at the rinsing stage of the wash cycle. In use the compositions of this invention are added to the rinse water in sufficient quantity to provide the desired effect. Generally the compositions will be added to provide from 5 to 500 parts by weight of (A) and (B) combined per million parts of rinse water.

As hereinbefore described fabrics treated with the compositions of this invention have a handle which can Emulsion CA to a 6% by weight solution in water of di(hydrogenated-tallow) dimethylammonium chloride and thereafter adding suffficient water to restore the total solids content (siloxane +quaternary) to 6%. For example when 2 parts of emulsion NA was added to 100 parts of the 6% quaternary compound solution this was followed by the addition of 9.1 parts of water to provide a composition containing 0.67 part siloxane and 5.33 parts quaternary compound per 100 parts. The solution of the quaternary compound employed was prepared employing a small amount of surface active agent to stabilise the solution.

Each of the compositions, together with a composition to which no siloxane had been added, were dispersed in water at a rate to provide 3g total solids in 2 liters of water, the pH of the resulting dispersions being adjusted to 4.5 by the addition of acetic acid. The dispersions were then employed to treat pre-washed samples of cotton, polyester-cotton and cotton towelling by immersion for 15 minutes at 22° C. Following immersion the samples were allowed to drain and dry at 22° C. for 24 hours.

All of the treated samples had a soft handle (feel) but those treated with the siloxane-containing compositions were firmer with more 'body'.

The ability of the treated fabrics to absorb water (rewettability) was tested by placing a standard size drop of water on the sample held in gentle tension over the mouth of a beaker. The time taken for the drop to become absorbed in the fabric was recorded and the results obtained are shown in the following table.

| | Time (Seconds) | | |
|---|---|---|---|
| Composition | Cotton | Polyester Cotton | Cotton Towelling |
| 0% siloxane | 19 | 39 | 16 |
| 1% NA emulsion | 6 | 19 | 2 |
| 2% NA emulsion | 4 | 13 | 1 |
| 3% NA emulsion | 3 | 11 | 1 |
| 1% CA emulsion | 6 | 13 | 2 |
| 2% CA emulsion | 3 | 11 | 1 |
| 3% CA emulsion | 3 | 11 | 1 |

The results indicate the significantly improved rewettability of the fabrics treated according to this invention.

EXAMPLE 2

A nonionic siloxane emulsion ND was prepared and incorporated into a fabric conditioning composition as described in Example 1, except that the mixture of cyclic siloxanes was replaced with the same weight of a mixture of 77% of decamethylcyclopentasiloxane and 16.5% of dodecamethylcyclohexasiloxane and small percentages of cyclic siloxanes having up to 10 silicon atoms.

The results for rewettability were as follows:

| | Time (Seconds) | | |
|---|---|---|---|
| Composition | Cotton | Polyester Cotton | Cotton Towelling |
| 1% ND emulsion | 4 | 19 | 1 |
| 2% ND emulsion | 5 | 20 | 2 |
| 3% ND emulsion | 3 | 9 | 1 |

EXAMPLE 3

The procedure of Example 1 was repeated except that the weight of polydimethylsiloxane gum employed was reduced to 6.5 parts and the weight of cyclic methylsiloxanes correspondingly increased to 80.5 parts. The siloxane emulsions were designated NB and CB.

The results of the tests for rewettability were as shown in the following table.

| | Time (Seconds) | | |
|---|---|---|---|
| Composition | Cotton | Polyester Cotton | Cotton Towelling |
| 0% siloxane | 19 | 39 | 16 |
| 1% NB emulsion | 10 | 20 | 2 |
| 2% NB emulsion | 8 | 17 | 3 |
| 3% NB emulsion | 8 | 6 | 1 |
| 1% CB emulsion | 7 | 5 | 4 |
| 2% CB emulsion | 5 | 11 | 2 |
| 3% CB emulsion | 6 | 7 | 1 |

EXAMPLE 4

The procedure of Example 1 was repeated except that the weight of polydimethylsiloxane gum was increased to 25 parts and the weight of cyclic siloxanes correspondingly reduced to 75 parts. Only the siloxane non-ionic emulsion was prepared and this was designated NC.

The results of the tests for rewettability were as shown in the following table.

| | Rewettability (Seconds) | | |
|---|---|---|---|
| Composition | Cotton | Polyester Cotton | Cotton Towelling |
| 0% siloxane | 19 | 39 | 16 |
| 1% NC emulsion | 7 | 17 | 3 |
| 2% NC emulsion | 5 | 18 | 1 |
| 3% NC emulsion | 4 | 10 | 1 |

That which is claimed is:

1. An aqueous composition for the treatment of textiles which comprises water having dispersed therein (A) a cationic compound which is substantive to water rinse on textile fabrics and (B) a mixture comprising (i) from 5 to 30% by weight of a polydiorganosiloxane having a viscosity of at least 300 Pa.s at 25° C. and wherein at least 80 percent of the total organic substituents are methyl groups, any remaining substituents being monovalent hydrocarbon groups having from 2 to 6 inclusive carbon atoms, and (ii) from 95 to 70 percent by weight of a liquid methyl siloxane having from 2 to 8 inclusive silicon atoms in the molecule, wherein the relative proportions of (A) and (B) are present from 1 to 50 parts by weight o the cationic compound (A) per part by weight of (B) and wherein (A) and (B) are present in a total amount of from 5 to 35 percent by weight based on the aqueous total weight of the aqueous composition.

2. A composition as claimed in claim 1 wherein the polydiorganosiloxane (i) has a viscosity of at least one Kilopascal second at 25° C.

3. An aqueous composition as claimed in claim 2 wherein the methylsiloxane (ii) comprises one or more cyclic siloxanes represented by the general formula $(Me_2SiO)_x$ in which Me represents the methyl group and x has a value of 4, 5 or 6.

4. An aqueous composition as claimed in claim 1 wherein the organosiloxane (B) comprises a mixture of from 10 to 20 percent by weight of (i), and from 90 to 80 percent by weight of (ii).

5. An aqueous composition as claimed in claim 1 which has been prepared by forming dispersions of (A) and (B) in water and thereafter mixing said dispersions together.

6. An aqueous composition as claimed in claim 1 wherein there are present from 2 to 20 parts by weight of (A) per part by weight of (B).

7. A process for treating a textile which comprises immersing a textile in an aqueous liquor containing a composition as claimed in claim 1 there being present in said liquor from 5 to 500 parts by weight of (A) and (B) per million parts by weight of water.

* * * * *